US011852340B2

(12) United States Patent
Krueger et al.

(10) Patent No.: US 11,852,340 B2
(45) Date of Patent: Dec. 26, 2023

(54) SYSTEMS AND METHODS OF CONFIGURING A HEATING SYSTEM

(71) Applicant: Rheem Manufacturing Company, Atlanta, GA (US)

(72) Inventors: Joey Krueger, Oxnard, CA (US); Jorge Miguel Gamboa Revilla, Oxnard, CA (US); Hiram Osuna, Oxnard, CA (US); Bo Gao, Camarillo, CA (US); Bryan Perales, Oxnard, CA (US); Danilo Aguilar, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 504 days.

(21) Appl. No.: 17/217,038

(22) Filed: Mar. 30, 2021

(65) Prior Publication Data

US 2022/0316704 A1 Oct. 6, 2022

(51) Int. Cl.

| | |
|---|---|
| ***F23N 5/24*** | (2006.01) |
| ***F23N 3/06*** | (2006.01) |
| ***F23N 3/08*** | (2006.01) |

(52) U.S. Cl.

CPC ..... *F23N 5/242* (2013.01); *F23N 3/06* (2013.01); *F23N 3/082* (2013.01); *F23N 2225/04* (2020.01); *F23N 2231/10* (2020.01); *F23N 2231/20* (2020.01); *F23N 2235/04* (2020.01); *F23N 2235/10* (2020.01)

(58) Field of Classification Search

CPC . F23N 5/242; F23N 3/06; F23N 3/082; F23N 2225/04; F23N 2235/04

See application file for complete search history.

(56) References Cited

U.S. PATENT DOCUMENTS 1,493,552 A * 5/1924 James ..... F23N 3/02 236/14
5,090,303 A * 2/1992 Ahmed ..... B08B 15/023 454/238
7,275,533 B2 * 10/2007 Soeholm ..... F23N 5/18 454/238

(Continued)

*Primary Examiner* — David J Laux

(74) *Attorney, Agent, or Firm* — Eversheds Sutherland (US) LLP

(57) ABSTRACT

The present disclosure addresses systems, media, and methods of configuring a heating system comprising a plurality of combustion-type heating devices fluidly coupled to a vent system. Configuring the heating system includes receiving operating pressure data from one or more pressure sensors in a flue of one of combustion-type heating devices and the vent system. The operating pressure data from the one or more pressure sensors is indicative of a pressure at a corresponding location in the vent system. Configuring the heating system further includes comparing the operating pressure data to stored operational pressure data indicative of operational pressure ranges indicative of permissible operating parameters associated with preventing backflow of flue gases into the one of combustion-type heating devices and outputting instructions for a damper to at least partially open or at least partially close based at least in part on the operating pressure data and the stored operational pressure data.

17 Claims, 3 Drawing Sheets

(56) References Cited

U.S. PATENT DOCUMENTS

| | | | | |
|---|---|---|---|---|
| 2007/0209653 | A1* | 9/2007 | Beisheim | F23N 5/18 126/80 |
| 2009/0215375 | A1* | 8/2009 | Hagensen | F23N 5/203 126/502 |
| 2012/0083194 | A1* | 4/2012 | Hagensen | F23L 11/00 165/47 |
| 2012/0097154 | A1* | 4/2012 | Morales | F27D 19/00 126/85 R |
| 2012/0115408 | A1* | 5/2012 | Hagensen | F23N 5/242 165/185 |

* cited by examiner

SYSTEMS AND METHODS OF CONFIGURING A HEATING SYSTEM

FIELD OF INVENTION

Examples of the present disclosure relate to systems and methods of configuring a heating system, and more particularly to systems and methods for configuring a damper through a heating device.

BACKGROUND

Often, buildings may require heating systems to meet heating and hot water needs throughout the year. Modern heating systems often include multiple heating devices (e.g., boilers, heaters) working together to meet the heating and hot water requirements. These heating devices are configured to operate in a cascaded manner to provide both a capacity range as well as redundancy to prevent downtime. The heating device discussed above may be a gas-fired heating device, a liquid fuel-fired heating device, or any appliance that works using combustion. Due to combustion, each of the heating devices produces combustion products that include flue gases. It is practical, cost effective, space effective, and resource effective to connect a common manifold/vent to flues of the heating devices to exhaust the flue gas. In configurations having a common manifold/vent, the flue gas exhaust management is important. As long as each heating device continues operating normally, and as long as a positive pressure in the common manifold/vent is maintained, the flue gas produced by the heating devices will exhaust safely. In an event, when one of a heating appliance among the multiple heating devices fails/malfunctions or a negative pressure is established in the common manifold/vent for any reason, there could be potentially catastrophic consequences. For example, flue gases may enter back into a room housing the failed heating device, enter the heating device, and cause ignition issues. In some instances, the heating device may not start, or even worse, the heating device could catch on fire or explode, leading to safety hazards to the heating device, environment, and lives of people in the vicinity. Furthermore, the flue gases entering back into the structure being heated by the heating system pose significant health risks for people and animals in the structure.

To resolve the issue of flue gases entering into the heating device, dampers may be used. A damper may be installed at a flue of each of the heating devices. These dampers may help mitigate the risks and potential negative side effects of a heating device failing and/or a negative pressure being established in the vent system. Conventionally connection between the electronic damper and the heating device is limited, and the damper primarily acts as a standalone device. The dampers are mainly of two types: on/off type and modulating type. In the heating device employing the on/off damper, the heating device and the damper may have a safety interlock where the damper automatically closes in order to prevent the backflow of flue gasses from other heating devices connected to the common manifold/vent, if the heating devices were to lose power or seize firing. In the heating device employing the modulating damper, the damper houses its own controller. Based on signals from pressure sensors in the damper, the damper flap may adjust to regulate the pressure of the heating device. However, these dampers are configured to open/close or modulate based on pressure values that are hardcoded into the dampers, and do not account for operating condition of the heating devices, flues, or the common manifold/vent included in the heating system. If the heating system deviates or otherwise falls outside of this set of pre-conceived operating parameters, the dampers may not operate correctly. Further, if the values that are hardcoded into the heating system were calculated incorrectly, the dampers may be operating under a set of conditions that may not maintain the safety/integrity of the heating system. Also, servicing the damper with updated codes or manual adjustments may be challenging as the dampers are hard to reach, and there are possibilities of human error. Moreover, the process of setting up a heating system is extremely labor-intensive, and the setup process needs to be repeated every time a new heating device is installed into an existing heating system. Also, since the dampers are standalone devices, there is an added burden to commission and operate both the damper and the heating device simultaneously.

Thus, improvements for configuring a heating system that account for the current operating condition of the heating system and its sub-elements are desired.

SUMMARY

According to embodiments of the application, a computer-implemented method of configuring a heating system comprising a plurality of combustion-type heating devices is disclosed. The computer-implemented method includes receiving operating pressure data from one or more pressure sensors in a flue of one of combustion-type heating devices of the plurality of combustion-type heating devices and a vent system of the heating system, the vent system being fluidly connected to each of the plurality of combustion-type heating devices, the operating pressure data from each of the one or more pressure sensors being indicative of a pressure at a corresponding location in the vent system. The computer-implemented method also includes comparing the operating pressure data to stored operational pressure data indicative of operational pressure ranges indicative of permissible operating parameters associated with preventing backflow of flue gases into the one of combustion-type heating devices of the plurality of combustion-type heating devices. The computer-implemented method also includes outputting instructions for a damper associated with the one of combustion-type heating devices of the plurality of combustion-type heating devices, to at least partially open or at least partially close based at least in part on the comparison. In some embodiments, the outputting instructions for a damper is performed by a heating device controller or an external controller. The one or more pressure sensors as described herein may be located in the vent system and the flue.

In some embodiments, the computer-implemented method includes receiving operating temperature data from one or more temperature sensors in the flue of one of combustion-type heating devices of the plurality of combustion-type heating devices and the vent system of the heating system, the operating temperature data from each of the one or more temperature sensors being indicative of a temperature at a corresponding location in the vent system. The computer-implemented method also includes comparing the operating temperature data to stored operational temperature data indicative of operational temperature ranges indicative of permissible operating parameters associated with preventing backflow of flue gases into the one of combustion-type heating devices of the plurality of combustion-type heating devices, wherein the instructions are based at least in part on the comparison of the operating pressure data to stored operational pressure data and the comparison of the operating temperature data to stored operational temperature data.

In some embodiments, the computer-implemented method includes detecting the damper coupled to the one of combustion-type heating devices of in the heating system. The computer-implemented method also includes establishing a communication with the damper, and communicating the instructions to the damper. In some embodiments, the computer-implemented method of configuring the heating system includes receiving, through a Graphical User Interface (GUI) of the combustion-type heating device, the instructions, and operating the damper based on the instructions.

In some embodiments, the computer-implemented method of configuring the heating system may also include receiving one or more working parameters of the damper, and operating the damper through at least one of a GUI and a communication interface. In some embodiments, the computer-implemented method of configuring the heating system may further include receiving one or more working parameters of the damper. The computer-implemented method may further include determining a failure of the damper based on one or more working parameters of the damper. The computer-implemented method may also include outputting instructions to one of combustion-type heating devices of the plurality of combustion-type heating devices associated with the damper to turn off the one of the plurality of combustion-type heating devices in response to determining a failure of the damper.

In some embodiments, the computer-implemented method includes receiving operating data from a burner apparatus of one of the plurality of combustion-type heating devices. The computer-implemented method also includes determining the operating data indicates a malfunction of a sub-component of the burner apparatus. The computer-implemented method further includes, in response to determining that the malfunction is not a prohibitive malfunction, overriding any instructions to turn off the one of combustion-type heating devices of the plurality of combustion-type heating devices.

In some embodiments, the computer-implemented method includes identifying operating pressure data exceeds the stored operational pressure data. The computer-implemented method further includes outputting additional instructions to the damper to close based on the identification.

According to embodiments of the application, A heating system comprising a plurality of combustion-type heating devices coupled to a vent system is disclosed. Each combustion-type heating device of the plurality of combustion-type heating devices includes a heating device controller. The heating device controller is configured to receive operating pressure data from one or more pressure sensors in a flue of one of combustion-type heating devices of the plurality of combustion-type heating devices and a vent system of the heating system, the vent system being fluidly connected to each of the plurality of combustion-type heating devices, the operating pressure data from each of the one or more pressure sensors being indicative of a pressure at a corresponding location in the vent system. The heating device controller is configured to compare the operating pressure data to stored operational pressure data indicative of operational pressure ranges indicative of permissible operating parameters associated with preventing backflow of flue gases into the one of combustion-type heating devices of the plurality of combustion-type heating devices. The heating device is further configured to output instructions for a damper associated with the one of combustion-type heating devices of the plurality of combustion-type heating devices, to at least partially open or at least partially close based at least in part on the comparison.

A non-transitory computer-readable storage medium having a set of computer-executable instruction stored thereon, execution of which, by one or more processing devices, causing the one or more processing devices to perform operations of automatically configuring a heating system comprising a plurality of combustion-type heating devices, according to various embodiments described above and below.

DETAILED DESCRIPTION

Providing a "smart" heating system or self-configuring heating system would be advantageous for many reasons. First, such heating system significantly reduces a possibility for human error as described above, as the smart heating system would account for variables unforeseen during an initial setup of the heating device included in the heating system by monitoring, in real-time, the operating conditions of the heating device and various other sub-elements included in the heating system. Second, by comparing operating pressure data obtained in real-time as the heating system is operating with stored operational pressure data indicative of operational pressure ranges indicative of permissible operating parameters associated with preventing backflow of flue gases into the heating device, a level of redundancy is added, and the overall safety of the heating system is increased.

The present disclosure is directed to systems, media, and methods of configuring a heating system. The term "heating system" as used herein, shall refer to a plurality of combustion-type heating devices sharing a vent system. The vent system is fluidly connected to each of the plurality of combustion-type heating devices. Each heating device of the heating system may include, or be configurable to couple to, various control units and/or communications interfaces so that a user (e.g., an engineer, a software developer, a technician, etc.) may configure one or more of the combustion-type heating devices included in the heating system. To configure the combustion-type heating device(s), the stored operational pressure data indicative of operational pressure range indicative of permissible operating parameters associated with preventing backflow of flue gases into the combustion-type heating device(s) may be provided. The stored operational pressure data may be provided to a heating device controller (HDC) of the heating device or provided by a user through a Graphical User Interface (GUI). Using the stored operational pressure data, the HDC, an external controller or the user may output instructions to a damper operatively coupled to the heating device and the vent system to at least partially open or at least partially close based at least in part on the operating pressure data and the stored operational pressure data.

Figure 1:
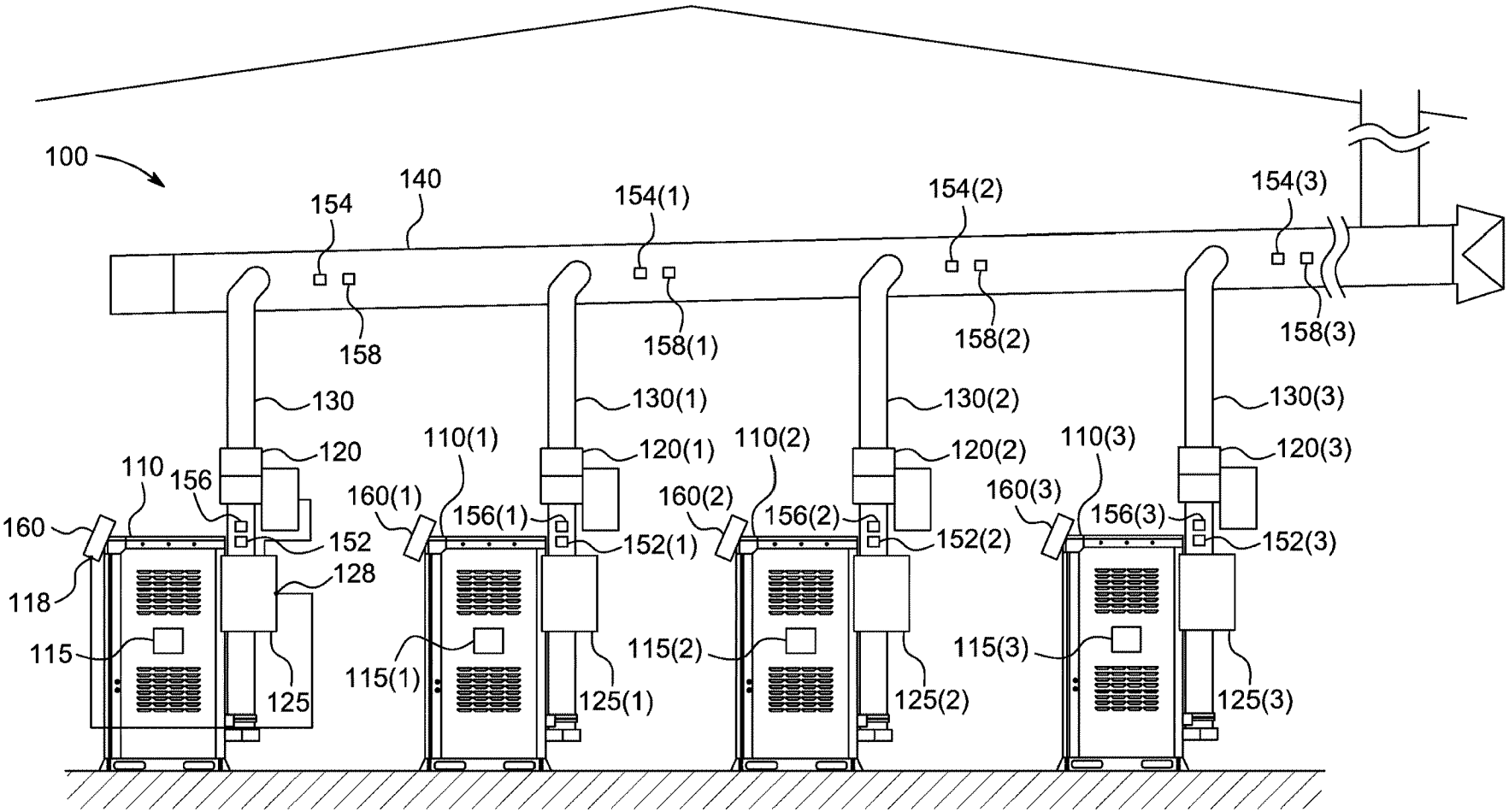
FIG. 1 illustrates a heating system, in accordance with embodiments of the present disclosure.

FIG. 1 illustrates an exemplary heating system 100, in accordance with embodiments of the present disclosure. The heating system 100 includes combustion-type heating devices 110, 110(1), 110(2) and 110(3) (collectively, "the heating devices 110" or individually "the heating device 110"), heating device controller units 115, 115(1), 115(2) and 115(3) (collectively, "the heating device controllers (HDCs) 115" or individually "the HDC 115"), dampers 120, 120(1), 120(2) and 120(3) (collectively, "the dampers 120" or individually "the damper 120"), damper control units 125, 125(1), 125(2) and 125(3) (collectively, "the damper control units (DCUs) 125"), flues 130, 130(1), 130(2) and 130(3) (collectively, "the flues 130" or individually "the flue 130"), a vent system 140, pressure sensors 152, 152(1), 152(2), 152(3), 154, 154(1), 154(2), and 154(3), temperature sensors 156, 156(1), 156(2), 156(3), 158, 158(1), 158(2), and 158(3), and an Input/output (I/O) units 160, 160(1), 160(2) and 160(3) (collectively, "the I/O units 160").

For the sake of simplicity, and throughout the ensuing discussion of FIG. 1, it can be assumed that the heating devices 110, 110(1), 110(2) and 110(3) (and all subcomponents included therein, such as the communication interfaces 118) are substantially similar or identical. Likewise, it can be assumed that the HDCs 115 and all subcomponents included therein, the dampers 120 and all subcomponents included therein, the DCUs 125 and all subcomponents included therein (e.g., the communication interfaces 128), the flues 130 and all subcomponents included therein, the pressure sensors 152, 152(1), 152(2), 152(3), 154, 154(1), 154(2) and 154(3), the temperature sensors 156, 156(1), 156(2), 156(3), 158, 158(1), 158(2), and 158(3) and the I/O units 160 are all substantially similar or identical to their respective counterpart (just as the heating devices 110 are presumed to be). Therefore, although the elements 110-160 will be referenced throughout the description of FIG. 1, it is to be understood that any description of the elements 110-160 applies equally to the elements 110(1-3)-160(1-3). Further, it is to be understood heating devices that are dissimilar to the heating devices 110 may be coupled to the vent system 140 or otherwise included in the heating system 100. Also, it can be appreciated that the disclosure is configured to work when heating devices that are dissimilar to the heating devices 110 may be coupled to the vent system 140 or otherwise included in the heating system 100.

In embodiments, the heating system 100 may include the heating device 110. The heating device 110 may be a boiler, a furnace, a heater, and any heating device used in heating air or heating water. The heating device 110 may include the HDC 115, an ignition module (not shown), and the I/O unit 160. The HDC 115 controls operations of the heating device 110. The HDC 115 may be implemented as one or more microprocessors, microcomputers, microcontrollers, digital signal processors, central processing units, graphical processing units, state machines, logic circuitries, and/or any devices that manipulate signals based on operational instructions. The heating device 110 may also include a memory unit (not shown) to store an operating system, firmware, operating instructions, stored operational pressure data, stored operational temperature data, and other information for operation and maintenance of the heating device 110. The operating instructions or a program to control the HDC 115 may be run within the operating system of the HDC 115. In some embodiments, the operating instructions or the program to control the HDC 115 may itself be an operating system or may be executed independently of the operating system. The operating system, the operating instructions, or the program may be configured to receive inputs through I/O unit 160, monitor and control components of the heating device 110, the HDC 115, the damper 120, and the DCU 125, and output the states, results, or any other information to the I/O unit 160 or any remote device directly or through a network. The operating system, the operating instructions, or the program may provide a Graphical User Interface (GUI) to receive input and provide output through I/O unit 160. The HDC 115 may be integrated/embedded into the heating device 110 and be accessible to a user of the heating device 110 via the I/O unit 160 such as touchscreen or other touch-sensitive display devices communicatively coupled to the heating device 110. In some embodiments, the HDC 115 may be a tablet or other mobile computing device that may electronically/communicatively coupled to the heating device 110 (e.g., via the communication interface 118).

The heating device 110 may also include burners, heat exchangers, supply lines, return lines, fireboxes, pumps, condensers, deaerators, and other devices (all of the components are not shown) controlled by the ignition module. The ignition module may be configured to control the heating of the heat exchangers through a management of fireboxes, pumps, condensers, deaerators, and fuel supply to burners. The normal operation of the ignition module and the other components, such as burners, heat exchangers, supply lines, return lines, fireboxes, pumps, condensers, deaerators, and other devices, are known and are not explained in detail for the sake of brevity. The HDC 115 controls the operation of the ignition module.

The heating device 110 includes a damper 120. In an example, the damper 120 may be a motorized damper. The damper 120 is placed in the flue 130 and is operationally and communicatively coupled to the heating device 110. The damper 120 also is operationally coupled to the vent system 140 (e.g., via the flue 130). The damper 120 may be an on/off type, a modulating type, or any other type. The on/off type damper may include a damper flap that opens or closes to allow flue gases to flow out to the vent system 140. In some examples, the damper flap of the on/off type of damper operates in two states, that is an open flap state or a closed flap state. The on/off type of damper may or may not include a processing unit. The modulating type damper may include a damper flap that can be modulated to various positions depending on requirements of the heating device 110 to manage the pressure within the heating device 110. The modulating type damper may include a DCU.

In some embodiments, the damper 120 is configured by the HDC 110 to control the damper flap based on instructions provided by the HDC 110. The HDC 110 outputs the instructions at least in part on comparing the operating pressure data to stored operational pressure data. The stored operational pressure data are a range of pressure values having minimum and maximum flue pressure limits of the heating device 110 within which the heating device 110 operates safely. The stored operational pressure data serves as an information to the HDC 115 to monitor a pressure in the flue 130 of the heating device 110 and the vent system 140, and output instructions to the damper to control the damper flap accordingly, to ensure safe operation of the heating device 110. The stored operational pressure data may be obtained from the HDC 115 and the operating pressure values may be obtained from the pressure sensors 152 and 154, and the temperature sensors 156 and 158. In one or more embodiments, the DCU 125 may be a microprocessor, microcontrollers, a digital signal processor, a central processing unit, a state machine, a logic circuitry, and/or any devices that manipulate signals based on operational instructions. In one or more embodiments, the DCU 125 is communicatively coupled to the HDC 115. Non-limiting examples of the pressure sensors 152 and 154 include potentiometric pressure sensors, inductive pressure sensors, capacitive pressure sensors and piezoelectric pressure sensors. Non-limiting examples of the temperature sensors 156 and 158 include thermocouples, thermistors, and Resistance Temperature Detector (RTD).

The heating device 110 includes a flue 130. The flue 130 of the heating device 110 is an exhaust to let the flue gases escape from the heating device 110 to the vent system 140 due to draft created by combustion. The flow of the flue gases to the vent system 140 may be controlled by the damper 120. The vent system 140 may be a channel designed to allow flow of flue gases to escape the heating system 100 into atmosphere. The vent system 140 may operate as a negative draft system or as a positive pressure flue. The vent system 140 may be of different categories, which is for example, category I, category II, category III, category IV or other unclassified categories. The category of the vent system 140 may be determined based on the heating devices 110 and type of fuel used in the heating devices 110 coupled to the vent system 140. For example, category IV type vent system may be suitable for high-efficiency gas appliances characterized by positive vent pressures and lower vent temperatures. The categories are not described in detail herein as they are known in the art and for the sake of brevity.

The heating device 110 also includes the I/O unit 160. The input/output unit 160 is configured to receive input and provide output. The input/output unit 160 may include input units such as switches, levers, buttons, keyboard, mouse, microphone, tactile sensor, and the like, and output units include a light indicator, a screen, speaker, and the like, and a hybrid of input and output units such as a touch screen. The heating device 110 may include one or more interfaces (not shown) to enable communication between the components internally and with external devices. The interfaces may include communication units (not shown) that use various communications protocols, including but not limited to Universal Serial Bus (USB), Universal Asynchronous Receiver/Transmitter (UART), Modbus®, Inter Integrated Circuit (I2C), Serial Peripheral Interface (SPI), Controller Area Network (CAN), 2G, 3G, 4G, LTE, 5G, WiFi, WiMax, and Bluetooth, or a combination thereof to enable two-way (e.g., read and write) communications between the DCU 125, the HDC 115, the interfaces, the I/O unit 160 and with external network such as Local Area Network (LAN), Wide Area Network (WAN), internet, Narrowband IoT (NB-IoT), cloud, and the like. The heating device 110 may also include circuitry and other electrical elements such as wires, to electrically couple various components, supply power, and the like in the heating device 110.

In operation, the heating system 100 includes multiple heating devices 110, 110(1), 110(2) and 110(3), and the vent system 140. The vent system 140 is fluidly connected to each of the plurality of heating devices. Each heating device 110, 110(1), 110(2) and 110(3) operates independently of other heating device 110, 110(1), 110(2) and 110(3). The operation is now described with respect to one heating device 110, and one can appreciate that the description is applicable to the other heating devices 110(1), 110(2) and 110(3). The heating device 110 includes the HDC 115. The HDC 115 may be configured to receive operating pressure data from one or more pressure sensors 152 and 154, and/or operating temperature data from one or more temperature sensors 156 and 158. The pressure sensor 152 and/or the temperature sensor 156 are placed in the flue 130 of the heating device 110. The pressure sensors 154 and/or the temperature sensors 158 are placed in the vent system 140 of the heating system 100. The operating pressure data and the operating temperature data are indicative of pressures and temperatures, respectively, at a corresponding location in the flue 130 and the vent system 140.

In response to receiving the operating pressure data and/or the operating temperature data, the HDC 115 may compare the operating pressure data and/or the operating temperature data with stored operational pressure data and/or stored operational temperature data, respectively. The stored operational pressure data is indicative of operational pressure ranges indicative of permissible operating parameters associated with preventing backflow of flue gases into the heating device 110. Similarly, the stored operational temperature data is indicative of operational temperature ranges indicative of permissible operating parameters associated with preventing backflow of flue gases into the heating device 110. In one or more embodiments, the stored operational pressure data and the stored operational temperature data may be determined by a manufacturer of the heating device 110 in a laboratory or other testing environment prior to being installed in the field. In some implementations, the stored operational pressure data and/or the stored operational temperature data may be uploaded, programmed, installed, or otherwise input to the HDC 115 by the manufacturer by default or by a user of the heating system 100. The stored operational pressure data and/or the stored operational temperature data may also be provided in product datasheets along with the product to an end-user or a customer for their reference.

Based at least in part on the comparison, the HDC 115 generates instructions for the damper 120 associated with the heating device 110. In one or more embodiments, the instructions are to at least partially open the damper flap to release the flue gases due to combustion when pressure and/or temperature in the flue 130 is higher than the pressure and/or temperature in the vent system 140. In one or more embodiments, the instructions to at least partially close the damper flap is to prevent flue gases from the vent system 140 entering the flue 130 when pressure and/or temperature in the flue 130 is lower than the pressure and/or temperature in the vent system 140.

The HDC 115 may be configured to output the instructions to the damper 120 to at least partially open or at least partially close based at least in part on the comparison. In one example implementation, the HDC 115 may output the instructions to the damper 120 through the DCU 125. In response to the instructions, the DCU 125 or the damper 120 may at least partially open or at least partially close the damper flap. In some embodiments, HDC 115 may directly control the damper 120 to at least partially open or at least partially close the damper flap. In some embodiments, HDC 115 may control the damper 120 by outputting the instructions to relay controllers to at least partially open or at least partially close the damper flaps.

The HDC 115 is configured to monitor and obtain operating conditions of components of the heating device 110 periodically, non-periodically, or on need-basis. In one or more embodiments, the components may include the damper 120, the DCU 125, the pressure sensors 152 and 154, the temperature sensors 156 and 158, the I/O units 160, the ignition module, burner apparatuses, heat exchangers, supply lines, return lines, fireboxes, pumps, condensers, deaerators, and the like. In response to any of the components malfunctioning or functioning in deviation to standard operating parameters, the HDC 115 may generate an alert.

The alert may be in a form of a notification, an alarm, and the like. In some embodiments, the alert may be displayed on the I/O unit 160, such as a Graphical User Interface (GUI). In some implementations, the HDC 115 may display the component that is malfunctioning or deviating from the standard operating parameters on the GUI. In some embodiments, the HDC 115 may communicate a notification through a service such as a Short Message Service (SMS) and the like, to an operator or a manufacturer indicating an issue in the heating device 110.

In some embodiments, the HDC 115 is configured to monitor the damper 120 continuously or periodically. In implementations, when the damper 120 is installed and operatively and communicatively coupled to the heating device 110, the HDC 115 may detect a presence of the damper 120. The damper 120 may be operatively and communicatively coupled with the heating device 110 when the damper 120 is installed/commissioned or replaced in the flue 130. The damper 120 may be configured to be operatively and communicatively coupled with the heating device 110 through the life of the damper 120. After the detection of the damper 120, the HDC 115 establishes a two-way communication with the damper 120. Once the two-way communication is established with the damper 120, the HDC 115 outputs the instructions to the damper 120 to at least partially open or at least partially close based at least in part as per the requirements of the operation of the heating device 110.

In some embodiments, the damper 120 may include the DCU 125 to control operations of the damper 120. In some implementations, the HDC 115 may communicate the instructions to the DCU 125 to operate the damper 120. In an example, the instructions include commands to at least partially open or at least partially close the damper flap. Based on the instructions from the HDC 115, the DCU 125 may operate the damper 120. In some implementations, the HDC 115 may directly control the DCU 125 to operate the damper 120 by taking over the control of the DCU 125. In one or more implementations, the HDC 115 outputs the instructions to DCU 125 of the damper 120 to configure the damper 120 to operate independently. In an example, the instructions include a program code to obtain the operating pressure data and/or the operating temperature data, compare the operating pressure data with the stored operational pressure and/or compare the operating temperature data with the stored temperature data, and operate the damper flap at least in part based on the comparison. In some embodiments, the operational pressure data may be stored in the DCU 125. The operational pressure data and the operational temperature data may be based on a heater model. The stored operational pressure data and/or the stored operational temperature data may indicative of operational pressure range indicative of permissible operating parameters associated with preventing backflow of flue gases into the one of heating devices.

In one or more embodiments, the DCU 125 is configured to control or modulate the damper flap to enable normal operation of the heating device 110 and to prevent the external flue from the vent system 140 from getting into the heating device 110. For example, in normal operating conditions, the DCU 125 is configured to open the damper flap to release flue gases from the flue 130 when there is a positive pressure in the flue 130 in comparison with the pressure of the vent system 140. The DCU 125 closes the damper flap to prevent a flow of flue gases from the vent system 140 to the flue 130 when the pressure value in the vent system 140 exceeds the pressure value in the flue 130.

In some embodiments, the damper 120 may not have the DCU. In such embodiments, the damper 120 may be operated directly by the HDC 115. In some embodiments, the HDC 115 may send instructions to relay elements of the damper 120 to control the damper flap.

One or more sensors (e.g., the pressure sensor 152 and the temperature sensor 156), located downstream of the damper 120 at the flue 130 of the heating device 110, and one or more sensors (e.g., the pressure sensor 154 and the temperature sensor 158), located at the vent system 140 upstream of the damper 120 may provide pressure values periodically or in real-time. In some embodiments, the temperature sensors may be a part of the damper 120 or the heating device 110. As described, the damper 120 may be operationally coupled to the flue 130 of the heating device 110 and the vent system 140, and the damper 120 may be instructed by the HDC 115 to operate based at least in part on the comparison of the operating pressure data with the stored operational pressure data and/or comparison of the operating temperature data with the stored operational temperature data. For instance, the operating pressure data obtained by the pressure sensors 152 and 154, and the operating temperature data obtained by temperature sensors 156 and 158 may be indicative of the current operating condition of the heating system 100, and the operating pressure data and the operating temperature values may be obtained as the heating system 100 is operating in real-time. The operating pressure data and/or the operating temperature data obtained may be compared with the stored operational pressure data and/or the stored operational temperature data, respectively, which, in some examples, may have been pre-loaded onto the memory device included in the heating device 110. If the operating pressure data and the operating temperature data are within safe ranges and within the stored operational pressure data and/or the stored operational temperature data, the HDC 115 sends instruction to the damper 120 to operate in a normal or pre-configured manner.

In some examples, the damper 120 may be a modulating type damper. In some examples, the damper 120 may be an on/off type damper. In accordance with the present disclosure, the HDC 115 may be configured, for example, based at least in part on the result of comparing the operating pressure data with the stored operational pressure data and/or comparing the operating temperature data with the stored operational temperature data to control or modulate a damper flap of the modulating type damper through communicating instructions. In some examples, the HDC 115 may adjust the angular position of the damper flap of the modulating type damper so that the damper flap is fully open, fully closed, or partially open. In other examples, the HDC 115 may control the damper flap of the on/off type damper to fully open or fully close the damper flap through the instructions.

A servo motor, a stepper motor, various other types of electric motors, or a microcontroller supporting pulse width modulation, among others, or a combination thereof may be used to modulate or control the damper flap of the damper 120, regardless of damper type. Also, regardless of damper type, the angular position of the damper flap of the damper 120 may be adjusted based on at least in part in comparison of the operating pressure data with the stored operational pressure data or comparing the operating temperature data with the stored operational temperature data or a combination thereof.

Regardless of form factor of the HDC 115, the HDC 115 is configured to receive inputs entered through the GUI or other input units of the I/O unit 160, by a user to configure the heating device 110, the HDC 115 and/or the DCU 125. According to embodiments of the present disclosure, the user may be enabled to configure the HDC 115 to communicate the stored operational pressure data and the stored operational temperature data to the DCU 125 of the damper 120 or set operating values for the damper, and configure the damper 120 to operate the damper flap based on the stored operational pressure data and the stored operational temperature data. In some examples, the stored operational pressure data and the stored operational temperature data may be uploaded/input into a lookup table stored on a memory device included in/accessible by the heating device 110.

The HDC 115 may be further configured to obtain or read working parameters of the damper 120 from the DCU 125 and display, through at least one of the GUI, the output devices, and/or a computing device coupled thereto. The working parameters include positions of the damper flap, 'health' of the damper 120, such as a working condition of the damper flap. The HDC 115 may also obtain or read working parameters of components of the heating device 110 such as working parameters of the pressure sensors 152 and 154, working conditions of the temperature sensors 156 and 158, working conditions of actuator/motors supporting the damper flap, the ignition module, burner apparatuses, heat exchangers, supply lines, return lines, fireboxes, pumps, condensers, deaerators, and faults in electrical or mechanical components, errors in the components, and the like. The HDC 115 may also display working parameters of the damper 120 and the components of the heating device 110, through the GUI of the I/O unit 160 or any device coupled thereto. The HDC 115 may also be configured to periodically, dynamically or in real-time read, and present or broadcast working parameters of the damper 120, the heating device 110 and the components therein, to the output devices, a computing device and/or an IoT device connected to the HDC 115 connected directly or through networks. The HDC 115 may receive inputs to view more details of the working parameters such as state of the flap, pressures in the damper 120, and the like, and may provide output through the GUI.

Through the GUI of the I/O unit 160 or through any of the input device of the heating device 110, a user may be able to control the damper 120, the heating device 110, or any components therein. For example, the user may be able to provide instructions to the HDC 115 and/or the DCU 125 through the GUI of the I/O unit 160. For example, the user may be able to set points for the damper 120 (write) through the DCU 125 via the GUI. In another example, the user may able to switch on/off the heating device 110 through HDC 115 via the GUI. In another example, the user may able to increase the temperature of the air by increasing the fuel supply to the heating device 110 through HDC 115 via the GUI. In another example, the user may able to open or close the damper flap through the GUI of the I/O unit 160. The GUI of the I/O unit 160 may also be configured to provide working parameters and operating conditions of the components of the heating device 110 and/or the damper 120. Based on the working parameters and operating conditions of the components the heating device 110 and/or the damper 120, the user may be able to provide additional instructions or control the operations of the components the heating device 110 and/or the damper 120.

In some embodiments, the heating device 110 and/or the damper 120 may also be accessed and controlled through an external device. For example, a computing device such as a laptop, a computer, a mobile device, a tablet, a PDA, or such devices can be communicatively connected to the heating device 110 through the interfaces described above. Once communicatively connected, the heating device 110 and/or the damper 120 may be accessed through HDC 115. In some example implementations, the UI that is similar the UI provided in GUI may be provided on the external device for the user to interact with the heating device 110 and/or the damper 120. In some embodiments, the heating device 110 and/or the damper 120 may be accessed and controlled remotely using an external device over the network or internet.

In some embodiments, the HDC 115 may also be configured to operate or troubleshoot the damper 120 and its components through the communications interface 118/228. The communication interface 118 and the communication interface 128 may be a wired communication interface, a wireless communication interface and/or a combination of the wired communication interface and the wireless communication interface. The communication interface 118 and the communication interface 128 are shown only for heating device 110 for the sake of brevity, it should be appreciated that corresponding communication interface 118(1-3) and the communication interface 128(1-3) exist for other heating device 110(1-3).

The HDC 115 may include an electronic interface (not shown) to enable communication of the heating device 110 with external devices. The HDC 115 may include a wired interface and/or a wireless interface to connect and communicate with the external devices. Examples of wired interface include a USB, LAN interface, and the like. The wireless interface includes WiFi, Bluetooth, NFC, and the like. The external device may be communicatively coupled to the heating device 110 at the location of the heating device 110 or remotely. In some embodiments, the heating device 110 may be connected and controlled by the external device through Narrowband IoT (NB-IoT) using proprietary applications such as Raymote®. The external device includes but is not limited to a computer, a laptop, a mobile communication device, a tablet, a Personal Digital Assistant (PDA), an IoT device, or any other computing device and can also include another heating device.

According to embodiments, the HDC 115 may be configured to turn off the heating device 110 in an event of failure/malfunction of the damper 120. In such event, the HDC 115 or the DCU 125 may hold the damper flap to exhaust the remaining flue gas up to a point where the flue 130 has positive pressure in comparison with the vent system 140, and may shut the damper flap immediately to prevent flow of external flue gas into the heating device 110 from the vent system 140. The HDC 115 may be further configured to operate the heating device 110 and the damper 120 responsive to failure/malfunction of a component of the heating system 100 outside of the ignition module of the heating system 100. For example, in an event of the touch screen failure, the I/O unit 160 failure, or any component fails which may not impact the operation of the heating device 110 or the heating system 100 or cause a safety hazard or is not a prohibitive malfunction, the HDC 115 may continue to normally operate the heating device 110 and the damper 120 in a 'limp along mode' albeit the failed components. In some embodiments, the HDC 115 may be further configured to operate the heating device 110 and the damper 120 responsive to failure/malfunction of a component of the heating system 100 within the ignition module of the heating system 100. For example, the HDC 115 may receive operating data from a burner apparatus of the heating device 110. The HDC 115 may determine that the operating data indicates a malfunction of a sub-component of the burner apparatus. The HDC 115 may determine whether the malfunction is a prohibitive malfunction or not. In response to determining that the malfunction is not a prohibitive malfunction, the HDC 115 overrides any instructions to turn off the heating device 110. There may be instances where the damper 120 may fail. The HDC 115 may be configured to monitor the damper 120 and/or the DCU 125 periodically or continuously in real-time to detect the failure of the damper 120. As a part of monitoring, the HDC 115 may receiving one or more working parameters of the damper 120 and/or the DCU 125. Based on the one or more working parameter, the HDC 115 may determine a failure of the damper 120 and/or the DCU 125. In response to determining the failure of the damper 120 and/or the DCU 125, the HDC 115 may output shutdown instructions to ignition module the heating device 110 to turn off the ignition.

In various embodiments, the HDC 115 and/or the DCU 125 may be configured to identify when the pressure in the vent system 140 exceeds the pressure in the flue 130, and control the damper 120. In such a scenario, the HDC 115 and/or the DCU 125 control the damper 120 to shut the damper flap to prevent a flow of flue gases from the vent system 140 to the flue 130. Optionally or additionally, the HDC 115 may increase the combustion in the heating device 110 to increase and overcome the pressure of the vent system 140 or shut down the heating device 110 to prevent a possibility of a safety hazard.

Figure 2:
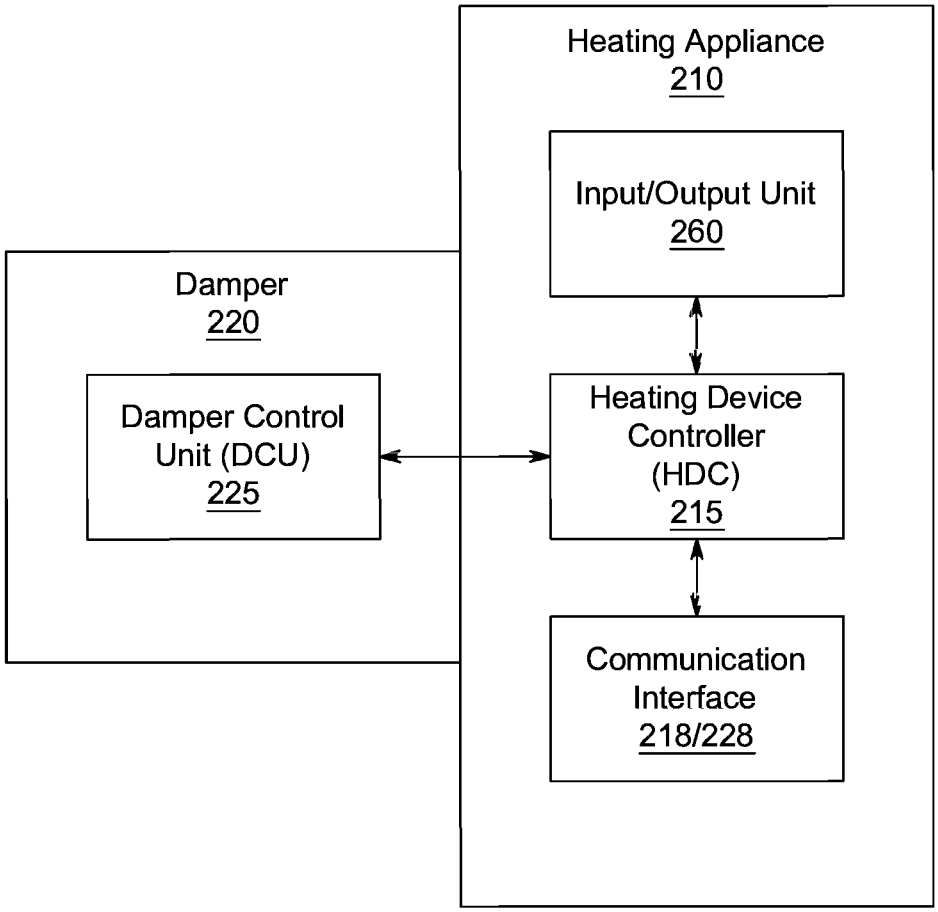
FIG. 2 depicts a heating device, in accordance with embodiments of the present disclosure.

FIG. 2 depicts a heating device 210 that may be included in a heating system, in accordance with embodiments of the present disclosure. The heating device 210 may be a boiler, a furnace, a heater or any heating device. The heating device 210 includes an HDC 215, a communication interface 218/228, and an I/O device 260.

A damper 220 may be operationally and communicatively coupled to the heating device 210 at a flue (not shown) of the heating device 210. The damper 220 may include a damper control unit (DCU) 225. In some embodiments, the DCU 225 may be communicatively and/or operatively coupled to the damper 220. When the damper 220 is installed and operationally and communicatively coupled to the heating device 210, the HDC 215 detects the presence of the damper 220. In response to detecting the presence of the damper 220, the HDC 215 establishes communication with the damper 220. The HDC 215 may configure the damper 220 to operate the damper flap to at least partially open or at least partially close based on the instructions provided by the HDC 215. The damper 220 is a device configured to control the flow of flue gases from the heating device 210 to a vent system, and to prevent external flue gases from a vent system from entering the heating device 210.

In some embodiments, the damper 220 and the DCU 225 are included in the heating device 210. Similarly, the HDC 215, the communication interface 218/228, and the I/O 260 are also included in the heating device 210. However, it is to be understood that the damper 220, the DCU 225, the HDC 215, and the I/O 260 may be located external to the heating device 210. For instance, the damper 220 may be located in a vent system, the vent system being coupled to multiple heating devices of the heating system (not shown). In other examples, the damper 220 may be included in the heating device 210 (as illustrated in FIG. 1) in addition to a damper located in the vent system to increase redundancy and safety of the heating system.

In FIG. 2, the DCU 225 is communicatively coupled with the HDC 215. The HDC 215 detects, communicates, configures and controls the DCU 225. The HDC 215 is in two-way communication with both the communication interface 218/228 and the I/O 260. Various communications protocols, including but not limited to Universal Serial Bus (USB), Universal Asynchronous Receiver/Transmitter (UART), Modbus®, Inter Integrated Circuit (I2C), Serial Peripheral Interface (SPI), Controller Area Network (CAN), 2G, 3G, 4G, LTE, 5G, WiFi, WiMax, and Bluetooth, or a combination thereof may enable two-way (e.g., read and write) communications between the DCU 225, the HDC 115, the communication interface 218/228, and the I/O 260.

According to the present disclosure, the heating device 210 (and all sub-components thereof) may be implemented in a heating system such as the heating system 100 depicted in FIG. 1. Therefore, the details of the heating device(s) discussed throughout the description of FIG. 1 may, in certain embodiments, apply directly and equally to the heating device 210 and the sub-components included therein (for example, the damper 220, the DCU 225, the HDC 215, the communication interface 218/228, and/or the I/O 260).

The HDC 215 outputs instructions for the damper 220 to operate based at least in part on the comparison of the comparison of the operating pressure data to stored operational pressure data and/or the comparison of the operating temperature data to stored operational temperature data. A flap included in the damper 220 may be modulated or opened/closed by the damper 220 according to an operating condition that may be determined at least in part based on the comparison. The DCU 225 and HDC 215 may include a combination of sensors, transducers, transceivers, and the like enabling the collection of data, the data in turn is stored on a memory device(s) included therein or elsewhere throughout the heating system. Further, the circuitry included in the DCU 225/HDC 215 may enable communication between the sub-components of the heating system, thus allowing data to be transferred between control units, controllers, logic units, circuits, memory devices, etc.

The communications interface 230 and the I/O 260 may further enable the exchange/transmission of data between the various sub-elements of the heating system in which the heating device 210 is included. Moreover, the communications interface 230 and the I/O 260 may enable a user of the heating device 210 to manually input or otherwise manipulate data stored on the memory devices throughout the heating system to configure the various sub-elements included in the heating system.

Figure 3:
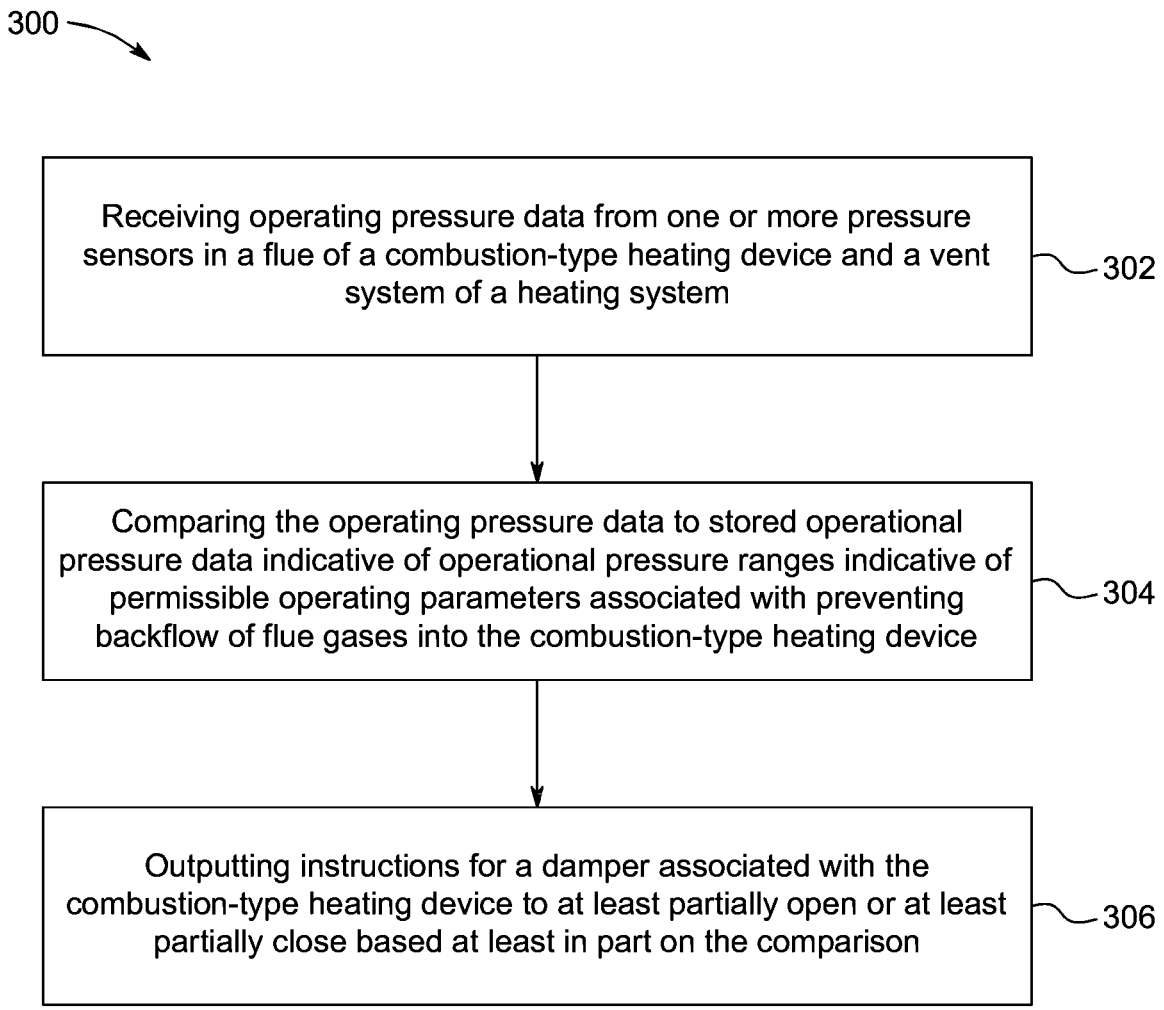
FIG. 3 is a flowchart outlining a method of configuring the heating system, in accordance with embodiments of the present disclosure.

FIG. 3 is a flowchart outlining a method 300 of configuring a heating system 100, in accordance with embodiments of the present disclosure. The heating system 100, and the sub-elements included therein, discussed throughout the description of FIG. 3 may be substantially similar or identical to the heating system 100.

The method 300 includes, at step 302, receiving operating pressure data from one or more pressure sensors 152 and 154 in the flue 130 of a heating device 110, 210 and the vent system 140, respectively, of the heating system 100. The operating pressure data may be obtained in "real-time" as the heating system 100 is operating in the field, and are indicative of a pressure in the flue 130 of the heating device 110, 210 and the vent system 140 of the heating system 100.

At step 304, the method 300 includes comparing the operating pressure data to stored operational pressure data indicative of operational pressure ranges indicative of permissible operating parameters associated with preventing backflow of flue gases into the heating device 110, 210. Also, the stored operational pressure data may be indicative of safe operating conditions of the heating device 110, 210. The stored operational pressure data may include a maximum pressure value and minimum pressure value and range of pressure values in between that the heating device 110, 210 is configured to safely operate. The stored operational pressure data may be determined in a laboratory or other testing environment prior to the heating system being installed in the field and may be uploaded or otherwise input to the various subcomponents of the heating system by a user of the heating system 100. For example, the stored operational pressure data may be uploaded/input to a memory device by a user (e.g., an engineer or software developer). The memory device may be included in/communicatively coupled to the HDC 115, 215 and/or the heating device 110, 210. The pre-established values may be uploaded to the memory device via a series of inputs made by the user, received through a GUI. At step 306, the method 300 includes outputting instructions for the damper 120, 210 associated with the heating device 110, 210 to at least partially open or at least partially close based at least in part on the comparison.

In embodiments, the method 300 may further include receiving operating temperature data from the one or more temperature sensors 156 and 158 in the flue 130 of the heating device 110, 210 and the vent system 140, respectively, of the heating system 100. The operating temperature data from each of the one or more temperature sensors are indicative of a temperature at a corresponding location in the vent system 140. The method 300 may further include comparing the operating temperature data to stored operational temperature data indicative of operational temperature ranges indicative of permissible operating parameters associated with preventing backflow of flue gases into the heating device 110. The method 300 includes outputting the instructions based at least in part comparison of the operating pressure data to stored operational pressure data and the comparison of the operating temperature data to stored operational temperature data.

According to embodiments, the damper 120, 220 may be a modulating type damper or an on/off type damper. Controlling the modulating type damper may include modulating a damper flap of the modulating type damper based at least in part on comparison of the comparison of the operating pressure data to stored operational pressure data and the comparison of the operating temperature data to stored operational temperature data. Controlling the on/off type damper may include opening or closing a damper flap of the on/off type damper based at least in part on the comparison of the operating pressure data to stored operational pressure data and the comparison of the operating temperature data to stored operational temperature data.

With the HDC 115, 215 identifying, configuring and/or controlling the DCU 125, 225, an operator or an user is assured that right or correct stored operational pressure data and/or stored operational temperature data (appliance vent pressure and/or temperature limits) are driving the operation of the damper 120, 220. These stored operational pressure data and the stored operational temperature data may be based on the heating device model and may be automatically uploaded to the damper 120, 220 without the need for the user to manually enter the information into the damper 120, 220. Also, with the HDC 115, 215 identifying, configuring and/or controlling the DCU 125, 225, the users may not have to struggle to access the damper 120, 220 which may be placed in locations difficult to access or that the damper 120, 220 may be positioned at a rear of the heating device 110, 210 or located in a confined space. Also, with the limp along mode, the HDC 115 ensures normal operation of the heating device 110, 210 and the damper 120, 220 in the heating system 100, thereby preventing the downtime. Furthermore, in an event of failure of the damper 120, 220, the HDC 115, 215 enables a safe operation of the heating device 110, 210 or shuts down the heating device 110, 210 to prevent any safety hazards. According to one or more embodiments of the disclosure, the HDC 115, 215 enables a platform for a universal interface technique where different types of dampers (for example, on/off, modulating or any other type damper) along with different blower voltages may be made compatible across different appliances. Regardless of the type of damper, the HDC 115, 215 may be able to configure the damper to the requirements of the heating device 110, 210. The methods and system disclosed herein allows for easier startup, safer operation and potential performance and reliability gains in the heating devices 110, 210. Also, with the HDC 115, 215 identifying, configuring and/or controlling the DCU 125, 225, there is an added level of safety for the heating device 110, 210.

It is to be appreciated that the Detailed Description section, and not the Abstract section, is intended to be used to interpret the claims. The Abstract section may set forth one or more but not all exemplary embodiments of the present application as contemplated by the inventor(s), and thus, is not intended to limit the present application and the appended claims in any way.

The present application has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the application that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present application should not be limited by any of the above-described exemplary embodiments, but should be defined only in accordance with the following claims and their equivalents.

The invention claimed is:

1. A computer-implemented method of configuring a heating system comprising a plurality of combustion-type heating devices, the method comprising:

receiving operating pressure data from one or more pressure sensors in a flue of one of the combustion-type heating devices of the plurality of combustion-type heating devices and a vent system of the heating system, the vent system being fluidly connected to each of the plurality of combustion-type heating devices, the operating pressure data f rom each of the one or more pressure sensors being indicative of a pressure at a corresponding location in the vent system;

receiving operating temperature data from one or more temperature sensors in the flue of one of the combustion-type heating devices of the plurality of combustion-type heating devices and the vent system of the heating system, the operating temperature data from each of the one or more temperature sensors being indicative of a pressure at a corresponding location in the vent system;

comparing the operating pressure data to stored operational pressure data indicative of operational pressure ranges indicative of permissible operating parameters associated with preventing backflow of flue gases into the one of the combustion-type heating devices of the plurality of combustion-type heating devices;

comparing the operating temperature data to stored operational temperature data indicative of operational temperature ranges indicative of permissible operating parameters associated with preventing backflow of flue gases into the one of the combustion-type heating devices of the plurality of combustion-type heating devices; and outputting instructions for a damper to at least partially open or at least partially close based at least in part on the operating pressure data and, the stored operational pressure data, the operating temperature data, and the stored operational temperature data.

2. The computer-implemented method of claim 1, further comprising:

detecting the damper coupled to the one of the combustion-type heating devices of the heating system;

configuring the damper to operate based on the instructions; and operating the damper based on the instructions.

3. The computer-implemented method of claim 1, further comprising:

receiving, through a Graphical User Interface (GUI) of at least one of the combustion-type heating devices, the instructions; and configuring the damper to operate based on the instructions.

4. The computer-implemented method of claim 1, further comprising:

receiving one or more working parameters of the damper; and operating the damper through at least one of a GUI and a communication interface.

5. The computer-implemented method of claim 1, further comprising:

receiving one or more working parameters of the damper;

determining a failure of the damper based on the one or more working parameters of the damper; and outputting instructions to one of the combustion-type heating devices of the plurality of combustion-type heating devices associated with the damper to turn off the one of the plurality of combustion-type heating devices in response to determining a failure of the damper.

6. The computer-implemented method of claim 1, further comprising:

receiving operating data from a burner apparatus of one of the plurality of combustion-type heating devices;

determining the operating data indicates a malfunction of a sub-component of the burner apparatus; and in response to determining that the malfunction is not a prohibitive malfunction, overriding any instructions to turn off the one of combustion-type heating devices of the plurality of combustion-type heating devices.

7. The computer-implemented method of claim 1, wherein the outputting instructions for a damper is performed by a heating device controller or an external controller.

8. The computer-implemented method of claim 1, wherein the one or more pressure sensors are located in the vent system and the flue.

9. The computer-implemented method of claim 1, further comprising:

identifying operating pressure data exceeding the stored operational pressure data; and outputting additional instructions to the damper to close based on the identification.

10. A heating system comprising a plurality of combustion-type heating devices coupled to a vent system, wherein:

each combustion-type heating device of the plurality of combustion-type heating devices comprises a heating device controller configured to:

receive operating pressure data from one or more pressure sensors in a flue of one of the combustion-type heating devices of the plurality of combustion-type heating devices and the vent system which is fluidly connected to each of the plurality of combustion-type heating devices, the operating pressure data from each of the one or more pressure sensors being indicative of a pressure at a corresponding location in the vent system;

receive operating temperature data from one or more temperature sensors in the flue of one of the combustion-type heating devices of the plurality of combustion-type heating devices and the vent system of the heating system, the operating temperature data from each of the one or more temperature sensors being indicative of a pressure at a corresponding location in the vent system;

compare the operating pressure data to stored operational pressure data indicative of operational pressure ranges indicative of permissible operating parameters associated with preventing backflow of flue gases into the one of the combustion-type heating devices of the plurality of combustion-type heating devices;

compare the operating temperature data to stored operational temperature data indicative of operational temperature ranges indicative of permissible operating parameters associated with preventing backflow of flue gases into one of the combustion-type heating devices of the plurality of combustion-type heating devices; and output instructions for a damper to at least partially open or at least partially close based at least in part on the operating pressure data, the stored operational pressure data, the operating temperature data, and the stored operational temperature data.

11. The heating system of claim 10, wherein the heating device controller is further configured to:

detect the damper coupled to the one of the combustion-type heating devices of the heating system;

configure the damper to operate based on the instruction; and operate the damper based on the instructions.

12. The heating system of claim 10, wherein the heating device controller is further configured to:

receive, through a Graphical User Interface (GUI) of one of the combustion-type heating devices, the instructions; and configure the damper to operate based on the instructions.

13. The heating system of claim 10, wherein the heating device controller is further configured to:

receive one or more working parameters of the damper; and operate the damper through at least one of a GUI of the combustion-type heating device and a communication interface.

14. The heating system of claim 10, wherein the heating device controller is further configured to:

receive one or more working parameters of the damper;

determine a failure of the damper based on the one or more working parameters of the damper; and output instructions to one of the combustion-type heating devices of the plurality of combustion-type heating devices associated with the damper to turn off the one of the plurality of combustion-type heating devices in response to determining a failure of the damper.

15. The heating system of claim 10, wherein the heating device controller is further configured to:

receive operating data from a burner apparatus of one of the plurality of combustion-type heating devices;

determine the operating data indicates a malfunction of a sub-component of the burner apparatus; and in response to determining that the malfunction is not a prohibitive malfunction, override any instructions to turn off the one of the combustion-type heating devices of the plurality of combustion-type heating devices.

16. The heating system of claim 10, wherein the heating device controller is further configured to:

identify operating pressure data exceeding the stored operational pressure data; and output additional instructions to the damper to close based on the identification.

17. A non-transitory computer-readable storage medium having a set of computer-executable instructions stored thereon, execution of which, by one or more processing devices, causes the one or more processing devices to perform operations of automatically configuring a heating system comprising a plurality of combustion-type heating devices, the operations comprising the steps of:

receiving operating pressure data from one or more pressure sensors in a flue of one of the combustion-type heating devices of the plurality of combustion-type heating devices and a vent system of the heating system, the vent system being fluidly connected to each of the plurality of combustion-type heating devices, the operating pressure data f rom each of the one or more pressure sensors being indicative of a pressure at a corresponding location in the vent system;

receiving operating temperature data from one or more temperature sensors in the flue of one of the combustion-type heating devices of the plurality of combustion-type heating devices and the vent system of the heating system, the operating temperature data from each of the one or more temperature sensors being indicative of a pressure at a corresponding location in the vent system;

comparing the operating pressure data to stored operational pressure data indicative of operational pressure ranges indicative of permissible operating parameters associated with preventing backflow of flue gases into the one of the combustion-type heating devices of the plurality of combustion-type heating devices;

comparing the operating temperature data to stored operational temperature data indicative of operational temperature ranges indicative of permissible operating parameters associated with preventing backflow of flue gases into one of the combustion-type heating devices of the plurality of combustion-type heating devices; and outputting instructions for a damper to at least partially open or at least partially close based at least in part on the operating pressure data, the stored operational pressure data, the operating temperature data, and the stored operational temperature data.

* * * * *